US006287077B1

(12) United States Patent
Müller

(10) Patent No.: US 6,287,077 B1
(45) Date of Patent: Sep. 11, 2001

(54) ADJUSTABLE-PITCH BOAT PROPELLER

(75) Inventor: Peter Müller, Adliswil (CH)

(73) Assignee: Nasyc Holding S. A., Luxemburg (LU)

( * ) Notice: Subject to any disclaimer, the term of this patent is extended or adjusted under 35 U.S.C. 154(b) by 0 days.

(21) Appl. No.: 09/504,685

(22) Filed: Feb. 15, 2000

(30) Foreign Application Priority Data

Feb. 18, 1999 (DE) ..... 199 06 661

(51) Int. Cl.[7] ..... B63H 1/06
(52) U.S. Cl. ..... 416/157 R; 416/158; 416/159
(58) Field of Search ..... 416/155, 156, 416/157 R, 157 A, 158, 244 B, 159; 440/49, 50

(56) References Cited

U.S. PATENT DOCUMENTS

| | | | | |
|---|---|---|---|---|
| 2,501,617 | * | 3/1950 | Roesch | 416/156 |
| 2,747,676 | * | 5/1956 | Berninger et al. | 416/158 |
| 2,792,064 | * | 5/1957 | Smith | 416/157 R |
| 2,958,382 | * | 11/1960 | Covert et al. | 416/154 |
| 3,092,186 | * | 6/1963 | MacLean | 416/162 |
| 5,073,134 | | 12/1991 | Muller . | |

FOREIGN PATENT DOCUMENTS

| | | |
|---|---|---|
| 878 906 | 6/1953 | (DE) . |
| 1 065 339 | 2/1960 | (DE) . |
| 31 18 230 | 1/1983 | (DE) . |

* cited by examiner

*Primary Examiner*—Edward K. Look
*Assistant Examiner*—Ninh Nguyen
(74) *Attorney, Agent, or Firm*—Herbert Dubno; Andrew Wilford

(57) ABSTRACT

A boat propeller has a housing adapted to be fixed to a boat, a hub rotatable about a main axis on the housing, a plurality of generally radially projecting vanes pivotable on the hub, and an operating core shaft coaxially received in the hub, rotatable about the main axis but axially nondisplaceable relative thereto, and having a rear end projecting axially from the hub and a front end. A yoke is fixed to the rear core-shaft end and respective rods fixed to the yoke are connected to the vanes for pivoting the vanes on angular movement of the core shaft about the main axis. A cylinder axially fixed in the housing at the front core-shaft end holds an axially displaceable piston. A nut element having a nonbinding internal screwthread is threaded on a screw element. One of the elements is axially coupled to the piston and the other of the elements is axially coupled to the core-shaft front end. The cylinder can be pressurized to axially displace the piston and, by axial-to-rotary conversion via the elements, rotate the core shaft.

7 Claims, 1 Drawing Sheet

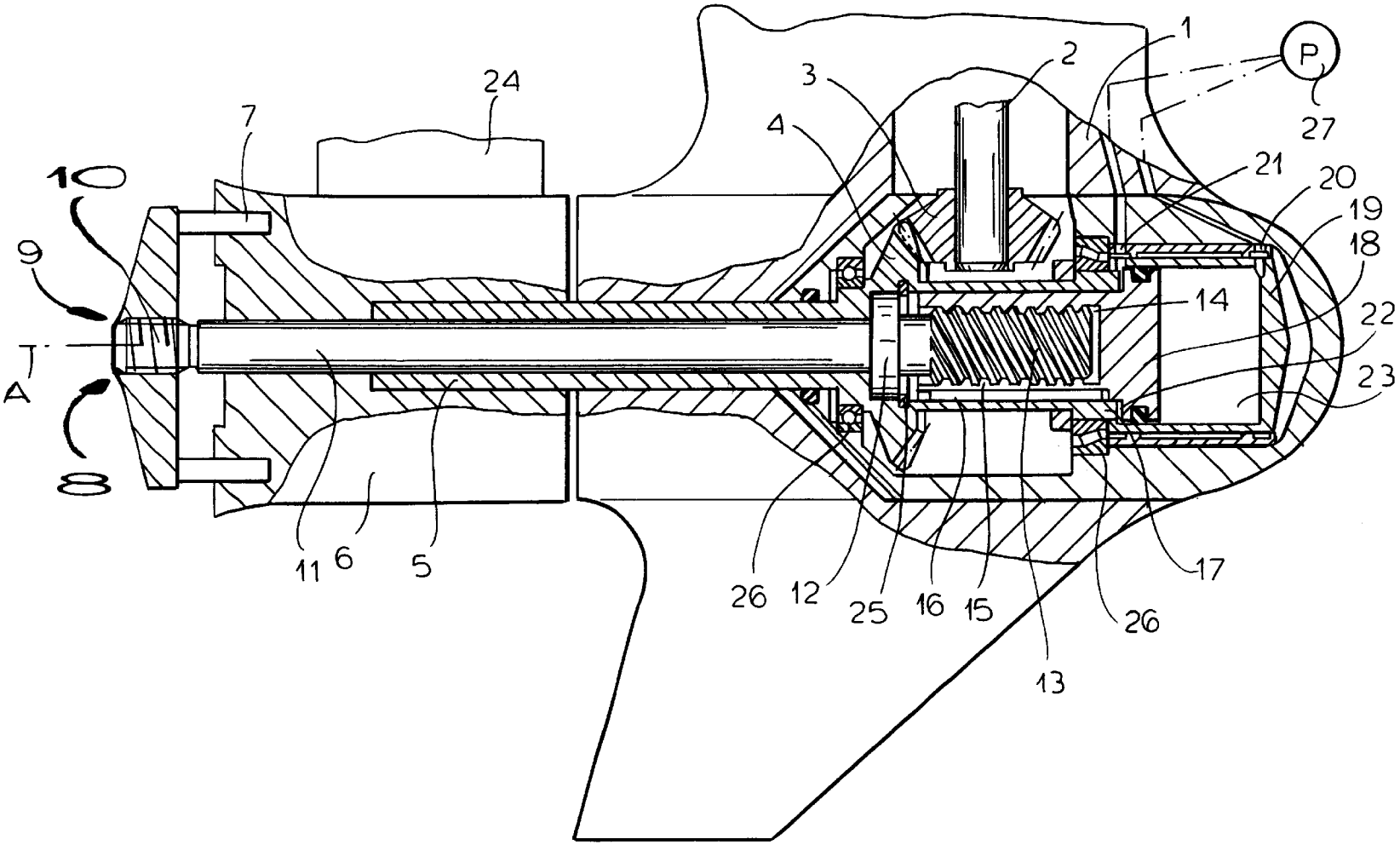
P
27
20
19
18
22
23
21
1
14
17
26
2
13
15
16
25
3
4
12
26
24
5
6
11
7
10
9
8
A

ADJUSTABLE-PITCH BOAT PROPELLER

FIELD OF THE INVENTION

The present invention relates to a boat drive. More particularly this invention concerns an adjustable-pitch propeller for a boat.

BACKGROUND OF THE INVENTION

A boat drive with a standard variable- or adjustable-pitch propeller is described in U.S. Pat. No. 5,073,134. It has a drive housing projecting from a hull of a boat, a tube shaft journaled in the housing and centered on a main axis, and a drive for rotating the tube shaft. A propeller hub mounted on the propeller shaft is provided with a plurality of adjustable-pitch propeller blades rotatable about respective axes generally radial of the main axis. Respective blade-adjustment rods extending parallel to the propeller shaft are shiftable axially to adjust a pitch of the blades and the hub has an end turned toward the housing and a free end turned away from the housing. A pitch-adjustment push rod passing through the propeller shaft and projecting out of the hub with one extremity of the push rod at the free end of the hub is axially shiftable in the propeller shaft by a double-acting piston-and-cylinder unit in the housing connected to the opposite extremity of the push rod. Another such system is described in German 3,118,230.

In German patent 878,906 of Wels the core shaft is axially fixed in the tube shaft and pivotal to change the setting of the propeller vanes. A worm gear meshing with a gear wheel on the core shaft is used to effect the desired rotation.

German patent 1,065,339 of Fischer has an axially displaceable core shaft whose front end is threaded in an axially fixed nut that can be coupled to the tube shaft for joint rotation therewith or coupled to the housing so that, when the tube shaft rotates relative to the housing, the screw moves axially in the nut and changes the vane setting.

These systems are all quite complex. Those with a core shaft normally rotating relative to the tube shaft are subject to considerable wear. The hydraulic arrangements often must be pressurized at high pressure to maintain a vane setting, and the all systems are quite complex.

OBJECTS OF THE INVENTION

It is therefore an object of the present invention to provide an improved adjustable-pitch propeller for a boat drive.

Another object is the provision of such an improved adjustable-pitch propeller for a boat drive which overcomes the above-given disadvantages, that is which is of simple construction and long service life.

SUMMARY OF THE INVENTION

A boat propeller has according to the invention a housing adapted to be fixed to a boat, a hub rotatable about a main axis on the housing, a plurality of generally radially projecting vanes pivotable on the hub, and an operating core shaft coaxially received in the hub, rotatable about the main axis but axially nondisplaceable relative thereto, and having a rear end projecting axially from the hub and a front end. A yoke is fixed to the rear core-shaft end and respective rods fixed to the yoke are connected to the vanes for pivoting the vanes on angular movement of the core shaft about the main axis. A cylinder axially fixed in the housing at the front core-shaft end holds an axially displaceable piston. A nut element having a nonbinding internal screwthread is threaded on a screw element. One of the elements is axially coupled to the piston and the other of the elements is axially coupled to the core-shaft front end. The cylinder can be pressurized to axially displace the piston and, by axial-to-rotary conversion via the elements, rotate the core shaft.

Thus with this system the axial stroke of the piston is converted by the nut/screw transmission into rotation of the core shaft, with the appropriate mechanical advantage. A modest pressure in the cylinder can effect the desired adjustment of the vanes about their radial axes and similarly very little pressure need be maintained to hold a vane setting. Using a very steep screwthread between the nut and screw allows a relatively long displacement of the piston to effect a relatively small rotation of the core shaft for extremely fine adjustment of the vane setting with a relatively simple low-pressure hydraulic system.

The yoke and core-shaft rear end are formed with complementary binding screwthreads. More particularly the core-shaft rear end is formed with an external binding screwthread and the yoke is formed with an internal binding screwthread. As is standard the term "binding" means that virtually the only way to relatively rotate two parts joined together by a binding screwthread is to apply angularly opposite forces or torques to them as no normally encountered amount of purely axial pressure will cause relative rotation. With a nonbinding screwthread, which typically is fairly steep, axial force applied to the one of the parts will readily cause the other to rotate.

The screw element according to the invention is fixed to the core shaft and the nut element is fixed to the piston. In addition the drive has a tube shaft rotatable in the housing about the main axis, coaxially surrounding the core shaft, and having a rear end carrying the hub. The core shaft is axially fixed shaft in the tube shaft while permitted to rotate about the main axis relative to the tube shaft. This fixing means is at the front end of the core shaft.

BRIEF DESCRIPTION OF THE DRAWING

The above and other objects, features, and advantages will become more readily apparent from the following description, reference being made to the accompanying drawing whose sole FIGURE is a partly schematic and partly sectional side view of the prop assembly according to the invention.

SPECIFIC DESCRIPTION

As seen in FIG. 1 a propeller has a housing normally formed at the lower end of an outboard engine. A vertical drive shaft in the housing has a lower end provided with a bevel gear 3 meshing with a bevel gear 4 carried on a tube shaft 5 supported by bearings 26 for rotation about a main axis A in the housing 1. The rear end of this tube shaft 5 carries a hub 6 on which are mounted a plurality of vanes 24 pivotal about respective vane axes extending generally radially of the axis A. Respective rods 7 have front ends attached via unillustrated linkages to the vanes 24 and rear ends fixed in a yoke element 8 having a threaded bore 9 in which is seated a threaded rear end 10 of a core shaft 11 coaxially received in the tube shaft 5. The screwthreads between the end 10 and bore 9 are of very small pitch so they are binding, that is virtually no amount of axial force on the shaft 11 or yoke 9 will cause them to slip and rotate relative to each other. The adjustment rods 7 are displaced angular in the hub 5 to set the pitch of the vanes 24 as shown in above-cited U.S. Pat. No. 5,073,134.

The front end of the core shaft 11 has an enlarged portion 12 that is captured by a snap ring 25 in the tube shaft 5 so this shaft 11 can rotate about the axis A in the shaft 5 but cannot move axially relative to it. A screw 13 formed or fixed on the front end of the core shaft 11 is threaded in a hole 14 of a nut 15 that is prevented from rotating in the tube shaft 5 by an interfitting spline/groove 16. The screwthread between the screw 13 and nut 15 is nonbinding, in fact of fairly steep pitch, so that axial movement of the nut 15 will result in rotation of the screw 13.

A piston 18 fixed to and in fact unitary with the nut 15 is axially slidable in a cylinder 19 carried on a front end 17 of the tube shaft 5 and subdivides the cylinder 19 into back and front compartments 22 and 23 fed by conduits 20 and 21 from a pump 27. Thus this piston 18 can be axially moved in the cylinder 19, which rotates with the tube shaft 5, by appropriate pressurization of the compartments 22 and 23.

With this arrangement rotation of the engine output shaft 2 will be transferred by the gear train 3, 4 to the tube shaft 5 to rotate the hub 6 and orbit the vanes 24. Normally the core shaft 11 with its yoke and the rods 7 will rotate jointly and synchronously with the tube shaft 5.

To adjust the pitch of the vanes 24, one of the compartments 22 and 23 is pressurized and the other is depressurized to axially shift the piston 18 and nut 15. This action turns the screw 13 in one direction or the other so as to rotate the core shaft 11 in the tube shaft 5 and thereby move the rods 7 angularly to effect the desired change in the vane angle.

I claim:

1. A boat propeller comprising:

a housing adapted to be fixed to a boat;

a hub rotatable about a main axis on the housing;

a plurality of generally radially projecting vanes pivotable on the hub;

an operating core shaft coaxially received in the hub, rotatable about the main axis but axially nondisplaceable relative thereto, and having a rear end projecting axially from the hub and a front end;

means including a yoke fixed to the rear core-shaft end and respective rods fixed to the yoke and connected to the vanes for pivoting the vanes on angular movement of the core shaft about the main axis;

a cylinder axially fixed in the housing at the front core-shaft end;

a piston axially displaceable in the cylinder;

a nut element having a nonbinding internal screwthread;

a screw element threaded in the nut element, one of the elements being axially coupled to the piston and the other of the elements being axially coupled to the core-shaft front end; and means for pressurizing the cylinder and thereby axially displacing the piston and, by axial-to-rotary conversion via the elements, rotating the core shaft.

2. The boat propeller defined in claim 1 wherein the yoke and core-shaft rear end are formed with complementary binding screwthreads.

3. The boat propeller defined in claim 2 wherein the core-shaft rear end is formed with an external binding screwthread and the yoke is formed with an internal binding screwthread.

4. The boat propeller defined in claim 1 wherein the screw element is fixed to the core shaft and the nut element is fixed to the piston.

5. The boat propeller defined in claim 1, further comprising a tube shaft rotatable in the housing about the main axis, coaxially surrounding the core shaft, and having a rear end carrying the hub; and means for axially fixing the core shaft in the tube shaft while permitting the core shaft to rotate about the main axis relative to the tube shaft.

6. The boat propeller defined in claim 5 wherein the means axially fixing the core shaft in the tube shaft is at the front end of the core shaft.

7. A boat propeller comprising:

a housing adapted to be fixed to a boat;

a hub rotatable about a main axis on the housing;

a plurality of generally radially projecting vanes pivotable on the hub;

an operating core shaft coaxially received in the hub, rotatable about the main axis but axially nondisplaceable relative thereto, and having a rear end projecting axially from the hub and a front end;

means including a yoke fixed by a binding screwthread to the rear core-shaft end and respective rods fixed to the yoke and connected to the vanes for pivoting the vanes on angular movement of the core shaft about the main axis;

a cylinder axially fixed in the housing at the front core-shaft end;

a piston axially displaceable in the cylinder;

a nut element having a nonbinding internal screwthread;

a screw element threaded in the nut element, one of the elements being axially coupled to the piston and the other of the elements being axially coupled to the core-shaft front end; and means for pressurizing the cylinder and thereby axially displacing the piston and, by axial-to-rotary conversion via the elements, rotating the core shaft.

* * * * *